United States Patent [19]

Tomita

[11] Patent Number: 4,505,502

[45] Date of Patent: Mar. 19, 1985

[54] MAGNETIC DOOR CATCH

[76] Inventor: Rioe Tomita, 47-126 Kaimalolo Pl., Kaneohe, Hi. 96744

[21] Appl. No.: 508,513

[22] Filed: Jun. 28, 1983

[51] Int. Cl.[3] ..... E05C 19/16

[52] U.S. Cl. ..... 292/251.5; 292/347; 292/DIG. 15

[58] Field of Search ..... 292/251.5, DIG. 15, 292/357, DIG. 53, 347; 411/402, 427

[56] References Cited

U.S. PATENT DOCUMENTS

| | | | |
|---|---|---|---|
| 440,006 | 11/1890 | Caldwell | 411/402 |
| 2,080,656 | 5/1937 | De Vries | 292/357 X |
| 3,163,453 | 12/1964 | Stephens | 292/251.5 |
| 3,244,443 | 4/1966 | Rodgers | 292/251.5 |
| 3,276,804 | 10/1966 | Heppner | 292/251.5 |
| 3,734,553 | 5/1973 | Sugasawara | 292/251.5 |

FOREIGN PATENT DOCUMENTS

| | | | |
|---|---|---|---|
| 1138231 | 12/1968 | United Kingdom | 292/251.5 |

*Primary Examiner*—Richard E. Moore
*Attorney, Agent, or Firm*—James C. Wray

[57] ABSTRACT

A magnetic catch holds a door in the open position. A cup-shaped metal element is supported for universal rotary motion in a plastic housing mounted on the door. A flat end of the element projects through an open end of the housing and contacts the exposed edge of a rectangular permanent magnet when the door is opened. The magnet is sandwiched between steel plates supported in the rectangular cavity of a plastic housing which is mounted on the floor or wall adjacent the door. A foam cushion resiliently biases the metal element away from the door. The magnet housing is supported on a hollow pedestal extending from a base. Mounting screws are stored inside the pedestal. Threaded plates screwed to the door and wall or floor mesh with threaded open ends of the metal element housing and the pedestal base respectively.

24 Claims, 9 Drawing Figures

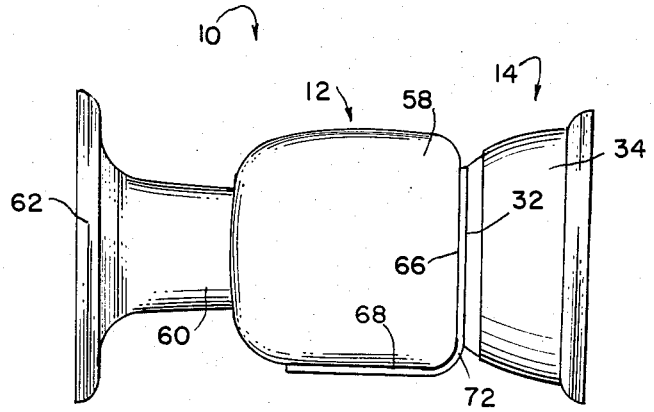
FIG. 1
FIG. 3
FIG. 2
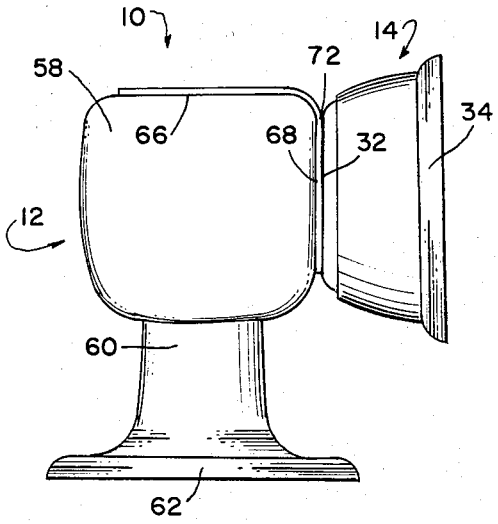
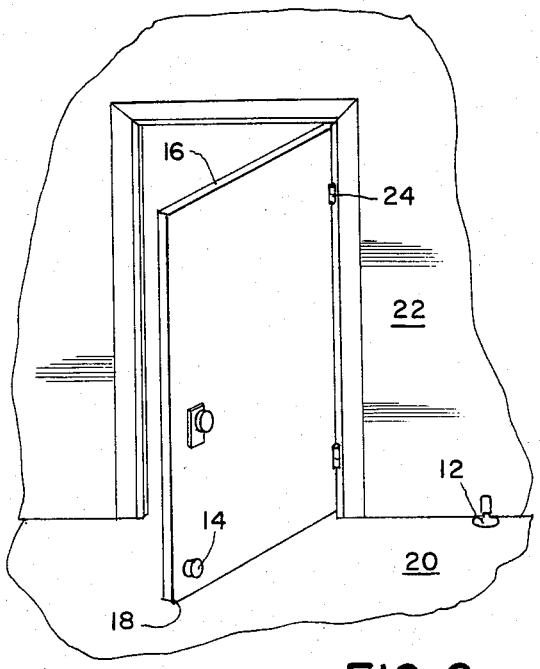
FIG. 6
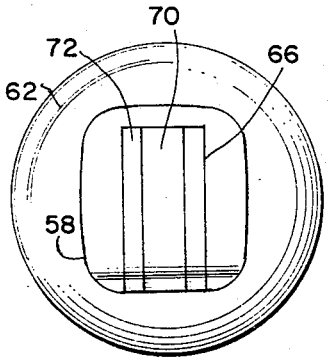
FIG. 5
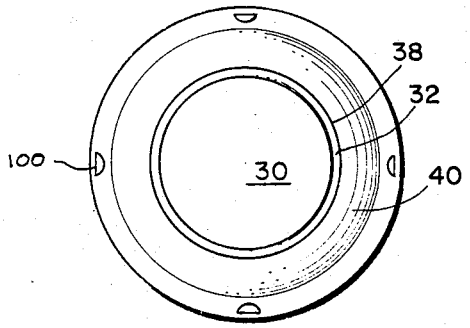
FIG. 4
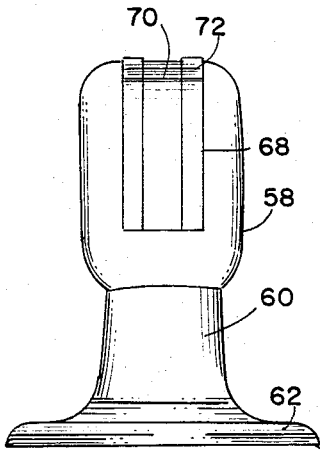

FIG. 7
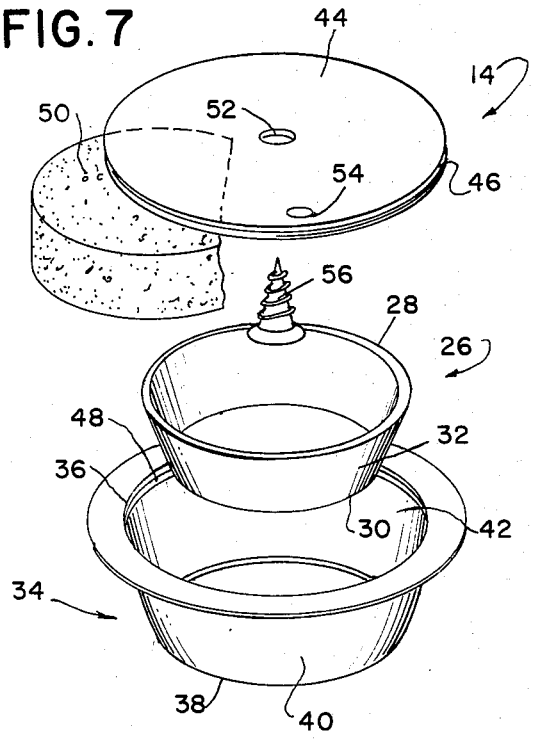
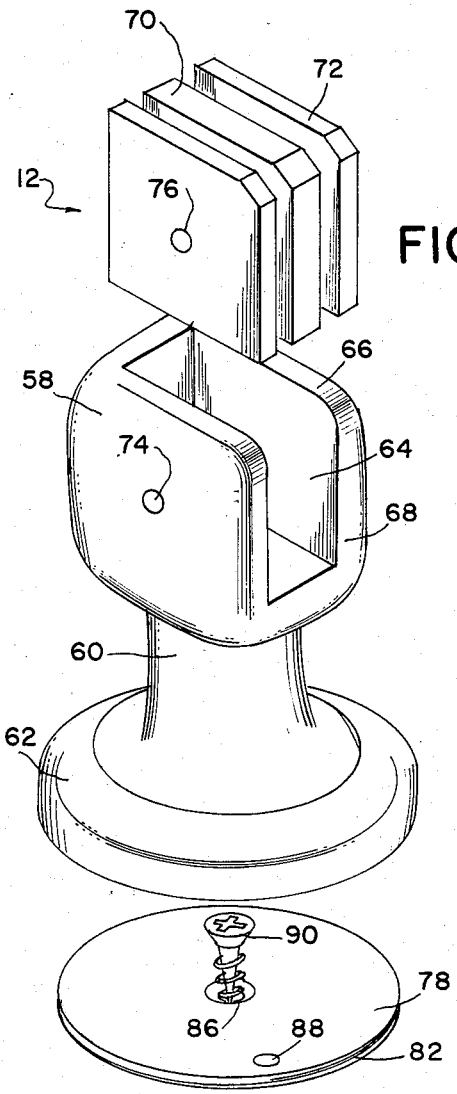
FIG. 8
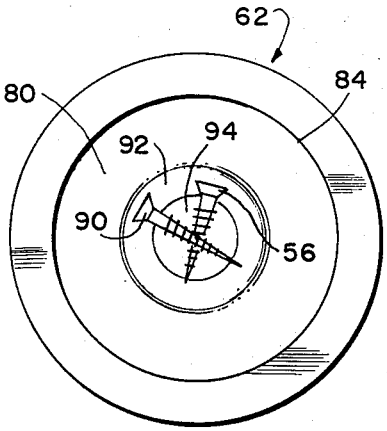
FIG. 9

MAGNETIC DOOR CATCH

BACKGROUND OF THE INVENTION

This invention relates generally to catch devices and more particularly has reference to a magnetic door catch.

Various types of catch devices have long been used to hold swingable or moveable structures in selected positions. For example, a known catch for holding a cabinet door in a closed position includes a bulbous-ended prong connected to the door which is adapted to fit between a pair of rollers spring biased toward each other and mounted on an inner surface of the cabinet.

A problem with that type of catch device is that it cannot be readily adapted for use with large, heavy doors, such as the main entryway doors in a building. The rigid structure of the catch would tend to damage a door which was slammed or opened quickly. There would be no compensation for misalignment of the door caused by aging or changes in temperature or humidity. There would be no means for easily mounting or unmounting the catch on the door or for concealing unsightly screws or other mounting devices. There would be no means for adapting the catch to the various mounting restrictions often encountered when dealing with entryway doors. In addition, there is no means for compactly packaging the known catches for marketing or storage.

Moreover, the known catch could not be readily adapted for holding a door in an open position. The protruding prong would be unsightly and dangerous.

A need thus exists for a catch mechanism which is suitable for use with large, heavy doors.

SUMMARY OF THE INVENTION

The present invention overcomes the problems which exist in the prior art devices.

The present invention provides a magnetic catch device for holding a door in an open position.

The catch device includes two units, namely, a magnetic unit and a magnetically attractable unit. The magnetic unit is mounted on the floor or wall behind the door and the magnetically attractable unit is mounted on the back of the door. The units are aligned to be horizontally coplanar. When the door is opened, the magnetically attractable unit moves along a horizontal arc and is brought into abutment with the magnetic unit. Magnetic force holds the units together, thereby fixing the door in the open position. The door is re-closed by applying a closing force which exceeds the magnetic force of the catch device.

The magnetically attractable unit includes a metal element mounted in a plastic housing for universal rotary motion. The ability of the metal element to rotate allows it to make firm contact with the magnetic unit despite the fact that the two units may be misaligned. Compensation is thus provided for warpage, breakage or mishanging of the door and for inaccurate installation of the catch device.

A foam cushion resiliently biases the metal element away from the door. The cushion compresses to act as a shock absorber when the metal element is brought into abutment with the magnetic unit. The cushion thus protects the door against shock damage.

The magnetic unit includes a rectangular permanent magnet positioned in a rectangular cavity formed in a rectangular plastic housing. Two adjacent edges of the magnet are exposed through the housing to allow the magnet to be presented toward the door when the housing is oriented in either of two positions. This permits a single magnetic unit to mounted either on the wall or the floor adjacent the door.

The units are mounted on their respective structures by screwing threaded open ends of the units onto threaded plates fastened to the structures by screws or other mounting means. This facilitates quick and easy mounting of the units and permits selective mounting and unmounting to replace defective units or for any other purpose. In addition, exposed screws or other unsightly mounting devices are eliminated because the threaded plates are concealed within the units when attached thereto.

The magnetic unit includes a base, an elongated pedestal extending from the base, and a magnet housing supported on the end of the pedestal remote from the base. The pedestal is hollow to accommodate mounting screws not in use. The screws are held in the pedestal by magnetic force produced by the permanent magnet in the magnet housing. The threaded plate screws into the base to close the end of the pedestal interior, thereby preventing removal of the screws from the pedestal. Those features are particularly useful for compactly packaging the catch device for its initial marketing and sale or for compactly storing the device when not in use.

Objects of the invention are, therefore, to provide an improved catch device and to provide a catch device which is particularly adapted for use with large, heavy doors.

Another object of the invention is to provide a magnetic device for holding a door in an open position.

Yet another object of the invention is to provide a catch device which is capable of compensating for misalignment of the door and for inaccuract mounting of the device.

Yet another object of the invention is to provide a catch device which absorbs impact shocks caused by rapid opening or slamming of the door, thereby preventing damage to the door.

A further object of the invention is to provide a a catch device having only two units, said units being selectively adaptable for a floor-mount or a wall-mount configuration.

Still another object of the invention is to provide a catch device which can be selectively mounted and unmounted on its respective supporting structure.

Yet another object of the invention is to provide a catch device having no exposed screws or other mounting means.

A further object of the invention is to provide a catch device having a hollow interior for storing mounting screws not in use.

Yet another object of the invention is to provide a catch device which can be compactly packaged.

Another object of the invention is to provide a catch device which can be easily mounted.

A further object of the invention is to provide a catch device which is relatively inexpensive.

Yet another object of the invention is to provide catch apparatus comprising a first member having magnetic means mounted thereon and a second member having a magnetically attractable element mounted thereon, one of said magnetic means and magnetically attractable means being mounted on its respective member for rotary motion in every direction.

Still another object of the invention is to provide in a door operating assembly comprising a door hinged to a wall upstanding from a floor, the improvement comprising a first member connected the door and a second member selectively connected to the wall or floor, the first and second members being substantially horizontally coplanar, magnetic means mounted on one of said first and second members and magnetically attractable means mounted on the other of said first and second members, said magnetic means and said magnetically attractable means being presented toward each other whereby they are brought into abutment with each other upon opening of the door and held together by magnetic force to retain the door in the open position.

These and other and further objects and features of the invention are apparent in the disclosure which includes the above and below specification and claims and drawings.

BRIEF DESCRIPTION OF THE DRAWINGS

FIG. 1 is a side elevational view of a catch device embodying features of the present invention.

FIG. 2 is a side elevational view of the catch device shown in FIG. 1 in an alternative configuration.

FIG. 3 is a perspective view showing the catch device of the present invention used in connection with a door.

FIG. 4 is an end view of the magnetically attractable unit of the catch shown in FIGS. 1–3.

FIG. 5 is a top plan view of the magnetic unit of the catch shown in FIG. 2.

FIG. 6 is a side view of the magnetic unit of the catch shown in FIG. 1.

FIG. 7 is an exploded view of the magnetically attractable unit shown in FIGS. 1–4.

FIG. 8 is an exploded view of the magnetic unit shown in FIGS. 1–3, 5 and 6.

FIG. 9 is a bottom view of the magnetic unit shown in FIG. 8 with the base plate removed.

DETAILED DESCRIPTION OF THE DRAWINGS

Referring to FIGS. 1 and 2, a catch device embodying features of the present invention is indicated generally by the numeral 10.

The catch 10 has two discreet units, namely, a magnetic unit 12 and a magnetically attractable unit 14. The units 12 and 14 can be held together by magnetic force in either of the configurations shown in FIGS. 1 and 2.

FIG. 3 shows an application of the catch configuration of FIG. 2.

The magnetically attractable unit 14 is mounted on the back surface of a door 16 adjacent the lower outside corner 18. The magnetic unit 12 is mounted on a floor 20 adjacent the wall 22 supporting the door hinges 24. The abutable portions of the units 12 and 14 are horizontally coplanar and are aligned with each other along an arc centered about the door hinges 24.

When the door 16 is in a partially open position, as shown in FIG. 3, the units 12 and 14 remain separate and the door moves freely. However, when the door 16 is fully opened, the magnetically attractable unit 14 is brought into abutment with the magnetic unit 12 and magnetic force holds the units 12 and 14 together in the configuration shown in FIG. 2. As a result, the door is locked in the fully opened position.

The units 12 and 14 in FIG. 3 are held in this position when sliding closet doors are used in place of wall 22.

The door can be returned to a partially open position or to a closed position by applying sufficient pressure to the back surface of the door 16 to overcome the magnetic force acting between the units 12 and 14. Such a force breaks the magnetic connection between the units 12 and 14 and allows them to separate.

The catch configuration shown in FIG. 1 can be applied to the door assembly of FIG. 3 simply by mounting the magnetic unit 12 on the wall 22 instead of the floor 20. The magnetic unit 12 would be mounted on the wall 22 adjacent the floor 20 and would extend outwardly from the wall 22. The magnetically attractable unit 14 would be mounted on the door 16 in the manner previously described. Movement of the door 16 into the fully open position would bring the magnetically attractable unit 14 into abutment with the magnetic unit 12 and magnetic force would hold those units 12 and 14 together in the configuration shown in FIG. 1.

Regardless of which configuration is used, the function of the catch 10 remains the same, namely, to hold the door in the fully open position. The choice of configuration depends upon the requirements of the particular application.

While the catch 10 has been shown for use in holding a door in a fully open position, it is understood that the catch 10 can be used to hold any type of moveable structure in any desired position. In addition, while the preferred application of the catch 10 mounts the magnetic unit on the stationary structure and mounts the magnetically attractable unit on the moveable structure, it is appreciated that the magnetic unit could be mounted on the moveable structure and the magnetically attractable unit could be mounted on the stationary structure, if desired.

Structural details of the magnetically attractable unit 14 are shown in FIG. 7.

A cup-shaped element 26 formed of magnetically attractable material, preferably steel, has a large open end 28 and a closed small end 30. An arcuate annular side wall 32 extends between the ends 28 and 30.

A cup-shaped housing 34 formed of non-attractable material, preferably plastic, has a large open end 36 and a small open end 38. The diameter of the large end 36 of the housing 34 is greater than the diameter of the large end 28 of the steel element 26. The diameter of the small end 38 of the housing 34 is greater than the diameter of the small end 30 of the steel element 26 but is smaller than the diameter of the large end 28 of the steel element 26. An annular side wall 40 extending between the ends 36 and 38 of the housing 34 has a curved inner surface 42 which is generally complementary to the side wall 32 of the steel element 26.

The steel element 26 is inserted into the housing 34 so that the flat closed end 30 of the element 26 is exposed through the small end 38 of the housing 34 as shown in FIG. 4. A portion of the side wall 32 adjacent the flat end 30 projects through the open end 38 of the housing 34 so that the flat end 30 of the steel element 26 is spaced from the end 38 of the housing 34.

The outer surface of the steel element side wall 32 abuts the curved inner surface 42 of the housing side wall 40. The abutting surfaces act as bearing surfaces to permit the steel element 26 to rotate in every direction within the housing 34, said rotation altering the orientation of the flat end 30 of the steel element 26 relative to the housing 34.

An end plate 44, preferably formed of plastic, closes the large end 36 of the housing 34. Screw threads 46 formed on the peripheral edge of the end plate 44 cooperate with screw threads 48 formed on the inner surface 42 of the housing 34 adjacent the large end 36 to permit the end plate 44 to be selectively connected to and disconnected from the housing 34, using depressions 100.

A cylindrical cushion 50, preferably formed of foam material, fits in the steel element 26 and extends between the closed end 30 thereof and the end plate 44. The cushion 50 has axial length which is greater than the distance between said closed end 30 and said end plate 44 so that it must be compressed when the unit 14 is assembled. Compression of the cushion 50 causes it to bias the steel element 26 away from the end plate 44, thereby holding the closed end 30 of the steel element 26 at its farthest position from the end 38 of the housing 34.

The end plate 44 is provided with a central opening 52 and a side opening 54. A mounting screw 56 extends through the central opening 52 for connecting the plate 44 to the desired structure, e.g., the door 16. The side opening 54 can receive a second screw (not shown), if desired, for further attaching the plate 44 to the structure and for preventing rotation of the plate 44 relative to the structure. Prior to mounting the plate 44 on the structure, a nail set or nail can be placed in the side opening 54 to facilitate rotation of the plate 44 relative to the housing 34 for selectively connecting and disconnecting the plate 44 and housing 34.

It will be appreciated that mounting of the unit 14 on the door 16 is accomplished by first fixing the end plate 44 to the door 16 with the screws 56, assemblying the steel element 26, cushion 50 and housing 34, and then screwing the housing 34 onto the end plate 44. Conversely, the unit 14 can be removed from the door 16 by unscrewing the housing 34 from the end plate 44.

Structural details of the magnetic unit 12 are shown in FIG. 8.

A generally rectangular housing 58 formed of nonmagnetic material, preferably plastic, is supported on the end of a pedestal 60 extending from a base 62. A generally rectangular cavity 64 is formed in the housing 58 and opens along the end 66 of the housing 58 remote from the base 62 and along a side 68 of the housing 58. A generally rectangular permanent magnet 70 sandwiched between a pair of similarly shaped steel plates 72 is positioned in the cavity 64 and held by a screw (not shown) which extends through aligned openings 74 and 76 in the housing 58, plates 72 and magnet 70. The dimensions of the magnet 70 and plates 72 are slightly larger than the dimensions of the cavity 64 so that the edges of the magnet 70 and plates 72 protrude slightly from the cavity openings 66 and 68.

A base plate 78, preferably formed of plastic, covers the open bottom end 80 (see FIG. 9) of the base 62. Screw threads 82 on the peripheral edge of the base plate 78 mate with corresponding screw threads 84 around the periphery of the open bottom end 80 of the base 62 to permit the plate 78 to be selectively connected to and disconnected from the base 62.

The base plate 78 is provided with a central opening 86 and a side opening 88 which serve the same purpose as the corresponding openings 52 and 54 in the end plate 44. A screw 90 is received in the central opening 86 for connecting the base plate 78 to the desired structure, such as the floor 20.

The unit 12 is mounted on the floor 20 or the wall 22 in a manner similar to the method for mounting the unit 14 on the door 16. The base plate 78 is first fixed to the floor 20 or wall 22 with the screws 90 and the base 62 is then screwed onto the base plate 78. The unit 12 is removed from the floor 20 or wall 22 by unscrewing the base 62 from the base plate 78.

As shown in FIG. 9, the pedestal 60 has a hollow interior 92 which is sufficiently long to accommodate the mounting screws 56 and 90 when not in use. Preferably, the end 94 of the hollow cavity 92 within the pedestal 60 is sufficiently close to the permanent magnet 70 so that magnetic force acts through the end 94 to hold the screws 56 and 90 in the cavity 92. The base plate 78 can be screwed onto the base 62 to close the open end 80 of the base 62 and prevent removal of the screws 56 and 90 from the pedestal cavity 92. These features allow the catch device 10 to be compactly packaged for shipment, storage, marketing and sale.

FIGS. 5 and 6 show the appearance of the magnetic unit 12 as viewed from the approaching attractable unit 14 in the two alternative configurations of the catch 10. FIG. 5 corresponds to the configuration shown in FIG. 1 and FIG. 6 corresponds to the configuration shown in FIG. 2. As shown in FIG. 5, the edge of the magnet 70 projecting through the end opening 66 of the cavity 64 is presented toward the approaching attractable unit 14 when the catch 10 is arranged in the configuration shown in FIG. 1. As shown in FIG. 6, the edge of the magnet 70 projecting through the side opening 68 of the cavity 64 is presented toward the attractable unit 14 when the catch 10 is arranged in the configuration shown in FIG. 2. It will be appreciated, therefore, that the same magnetic unit 12 is usable in either of the two alternative configurations of the catch 10.

The catch 10 has been described with reference to the rotatable element 26 being the magnetically attractable element and the fixed rectangular element 70 being the permanent magnet.

While the invention has been described with reference to specific embodiments, the exact nature and scope of the invention is defined in the following claims.

I claim:

1. Catch apparatus comprising a first member having magnetic means mounted thereon and a second member having a magnetically attractable means mounted thereon, one of said magnetic means and magnetically attractable means being mounted on its respective member for rotary motion in every direction, wherein one of said first and second members comprises a cup-shaped housing having an open end and the means mounted thereon comprises a cup-shaped element positioned within the housing and having an end formed of the means, which is exposed through the open end of the housing, the cup-shaped element having curved side walls which are complementary to curved side walls of the housing thereby permitting relative rotary movement in every direction between the cup-shaped element and the housing.

2. Catch apparatus comprising a first member having magnetic means mounted thereon and a second member having a magnetically attractable element mounted thereon, one of said magnetic means and magnetically attractable element being mounted on its respective member for rotary motion in every direction, wherein the second member comprises a cup-shaped housing having an open end and the magnetically attractable element comprises a cup-shaped element positioned within the housing and having an end formed of magnetically attractable material exposed through the open end of the housing, the cup-shaped element having curved side walls which are complementary to curved side walls of the housing thereby permitting relative rotary movement in every direction between the cup-shaped element and the housing.

3. The apparatus of claim 2 wherein the housing is formed of plastic and the cup-shaped element is formed of metal.

4. The apparatus of claim 2 wherein said end of the cup-shaped element projects through the open end of the housing.

5. The apparatus of claim 2 wherein means are provided for resiliently biasing the cup-shaped element toward the open end of the housing.

6. The apparatus of claim 5 wherein the biasing means comprises a resilient element positioned in the housing and extending between said end of the cup-shaped element and a closed end of the housing remote from said open end.

7. The apparatus of claim 5 wherein the resilient element comprises a cushion formed of foam material.

8. The apparatus of claim 1 wherein the second member comprises a housing having a threaded open end and a threaded end plate selectively matingly received in the threaded open end.

9. The apparatus of claim 8 wherein the end plate is provided with one or more openings.

10. The apparatus of claim 1 wherein the first member comprises a housing having a cavity formed therein, said magnetic means being positioned within the cavity.

11. The apparatus of claim 10 wherein the magnetic means comprises a permanent magnet.

12. The apparatus of claim 11 wherein the permanent magnet is sandwiched between steel plates.

13. The apparatus of claim 12 wherein the housing is formed of plastic.

14. The apparatus of claim 1 wherein the first member comprises a base, a pedestal extending from the base, and a housing supported on the end of the pedestal remote from the base, the housing being provided with a cavity opening along an end surface of the housing remote from the base and along a side surface of the housing, said magnetic means being positioned within the cavity and being exposed through said cavity opening.

15. The apparatus of claim 14 wherein the magnetic means projects through said cavity opening.

16. The apparatus of claim 1 wherein the first member comprises a base, a hollow pedestal extending from the base, and a housing supported on the pedestal, said magnetic means being mounted in the housing and said pedestal being sufficiently long to accommodate mounting screws positioned in the hollow interior thereof.

17. The apparatus of claim 16 wherein an end of the hollow interior of the pedestal is sufficiently close to the magnetic means to permit magnetically attractable mounting screws to be held in said hollow interior by magnetic force.

18. The apparatus of claim 1 wherein the first member comprises a base having a threaded open bottom end, a pedestal extending from the base, a housing supported on the pedestal, said magnetic means being mounted in the housing, and a threaded base plate selectively matingly received in the threaded bottom of the base.

19. The apparatus of claim 18 wherein the base plate is provided with one or more openings.

20. The apparatus of claim 14 wherein the cavity and the magnetic means have generally rectangular shapes.

21. In a door operating assembly comprising a door hinged to a wall upstanding from a floor, the improvement comprising a first member connected to the door and a second member selectively connected to the wall or floor, the first and second members being substantially horizontally coplanar, magnetic means mounted on one of said first and second members and magnetically attractable means mounted on the other of said first and second members, said magnetic means and said magnetically attractable means being presented toward each other whereby they are brought into abutment with each other upon opening of the door and held together by magnetic force to retain the door in the open position, wherein the second member comprises a cup-shaped housing having an open end and the magnetically attractable element comprises a cup-shaped element positioned within the housing and having an end formed of magnetically attractable material exposed through the open end of the housing, the cup-shaped element having curved side walls which are complementary to curved side walls of the housing thereby permitting relative rotary movement in every direction between the cup-shaped element and the housing.

22. The apparatus of claim 21 wherein one of the magnetic means and magnetically attractable means is pivotably and resiliently mounted on its respective member.

23. The apparatus of claim 21 wherein the first member is positioned adjacent a lower outer corner of the door.

24. The apparatus of claim 21 wherein the second member has a housing and wherein cubicles or notches are provided in peripheral areas of the housing for use with a nail set to tighten or loosen the housing.

* * * * *